US008038158B1

(12) United States Patent
White

(10) Patent No.: US 8,038,158 B1
(45) Date of Patent: Oct. 18, 2011

(54) INFANT CRAWLER

(76) Inventor: Cynthia M. White, Taylorsville, UT (US)

( * ) Notice: Subject to any disclaimer, the term of this patent is extended or adjusted under 35 U.S.C. 154(b) by 407 days.

(21) Appl. No.: 12/284,614

(22) Filed: Sep. 22, 2008

Related U.S. Application Data

(66) Substitute for application No. 60/994,777, filed on Sep. 21, 2007.

(51) Int. Cl.
*A01D 67/04* (2006.01)

(52) U.S. Cl. ..... 280/32.5; 280/87.051

(58) Field of Classification Search ..... 280/266, 280/87.021, 87.05, 32.5, 32.6, 87.051; 482/66, 482/51, 56, 68; 446/168, 227; 119/727, 119/725, 751
See application file for complete search history.

(56) References Cited

U.S. PATENT DOCUMENTS

| | | | | | |
|---|---|---|---|---|---|
| 1,572,273 | A | * | 2/1926 | Elton | 280/87.051 |
| D213,370 | S | | 2/1969 | Cherry | |
| 3,532,356 | A | | 10/1970 | Lillibridge | |
| 3,621,819 | A | * | 11/1971 | Hooper | 119/727 |
| 3,905,054 | A | * | 9/1975 | Windsor et al. | 280/87.021 |
| 3,970,325 | A | | 7/1976 | Wirsig | |
| 3,992,023 | A | | 11/1976 | Moorer | |
| 4,189,164 | A | | 2/1980 | Moorer | |
| 4,428,326 | A | * | 1/1984 | Dubovick et al. | 119/727 |
| 4,569,532 | A | | 2/1986 | Mirkarimi | |
| 4,792,147 | A | * | 12/1988 | Wissing | 280/32.6 |
| 4,796,565 | A | * | 1/1989 | Charbeneau | 119/751 |
| 4,796,903 | A | * | 1/1989 | Proctor et al. | 280/87.051 |
| 5,219,369 | A | * | 6/1993 | Gastle et al. | 5/600 |
| 5,244,443 | A | * | 9/1993 | Cerda | 280/87.051 |
| 5,275,426 | A | * | 1/1994 | Tankersley | 280/87.051 |
| 5,823,146 | A | * | 10/1998 | Alaniz et al. | 119/725 |
| 6,019,705 | A | | 2/2000 | Thom et al. | |
| 6,299,503 | B1 | * | 10/2001 | Lagrone | 446/227 |
| 6,820,572 | B1 | * | 11/2004 | Parkes | 119/727 |
| 7,182,351 | B2 | * | 2/2007 | Williams | 280/87.021 |
| 7,549,398 | B2 | * | 6/2009 | Robinson et al. | 119/727 |

* cited by examiner

*Primary Examiner* — Hau Phan
(74) *Attorney, Agent, or Firm* — Thorpe North & Western LLP

(57) ABSTRACT

An infant crawler includes a cover which can take many shapes, such as an animal shape or vehicle shape, secured to a wheeled crawler frame. The crawler frame can be moved around by an infant positioned in the crawler frame and the cover at least partially covers the infant positioned in the frame. The cover can include various pieces secured to various parts of the frame or can be or include a single piece removably secured to the frame. The crawler frame can be collapsible for easy transport and storage and can have a body supporting surface adjustable in height above the floor so can be adjusted for the particular user and for a particular user as the user grows to support the user at a proper height above the floor for the desired crawling action. In addition, the crawler frame can be length adjustable for adjustment as the user grows.

6 Claims, 9 Drawing Sheets

INFANT CRAWLER

PRIORITY CLAIM

This application claims the benefit of U.S. Provisional Patent Application 60/994,777 filed Sep. 21, 2007 which is herein incorporated by reference in its entirety for all purposes.

BACKGROUND OF THE INVENTION

1. Field

The invention is in the field of crawling or creeping devices for babies and infants.

2. State of the Art

Crawlers or creeping devices for babies or infants, both referred to hereinafter generally as infants, generally include a wheeled frame having a body supporting surface, such as a sling, suspended from the frame, on which the torso of an infant is placed so that its hands and feet can contact the ground in order move the crawler forward or backwards by using its arms and legs. However, such crawlers or creepers have the frame exposed so have a purely functional appearance with little play value.

SUMMARY OF THE INVENTION

According to the invention, an infant crawler or creeper includes a cover which can take many shapes, such as an animal shape, secured to a wheeled crawler frame. The crawler frame can be moved around by an infant positioned in the crawler frame and the cover at least partially covers the infant positioned in the frame. The movement of the crawler frame by the infant moves the shape formed by the cover along with the frame to provide play value and entertainment for the infant using the crawler and for people, such as parents, watching the infant move the crawler. For example, if the cover provides a turtle shape or representation, the infant, by moving the crawler around on a floor in a room, will give the appearance of a turtle moving around on the floor in the room. The cover can include various pieces secured to various parts of the frame, such as one or more side pieces secured to sides of the frame and one or more top pieces secured to the top of the frame, or can be or include a single piece removably secured to the frame to allow the infant to be placed in or removed from the frame when the piece is removed.

The crawler frame can be collapsible for easy transport and storage and can have a body supporting surface adjustable in height above the floor so can be adjusted for the particular user and for a particular user as the user grows to support the user at a proper height above the floor for the desired crawling action. The body support surface may be adjustable in relation to the frame and/or the legs of the frame can be length adjustable to adjust the position of the body supporting surface above the floor. In addition, the crawler frame can be length adjustable for adjustment as the user grows. Further, auxiliary legs can be provided for stabilization of the crawler or for support of the cover, if desirable or necessary.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

In the accompanying drawings, which show the best mode currently contemplated for carrying out the invention.

DETAILED DESCRIPTION OF THE ILLUSTRATED EMBODIMENTS

Figure 1:
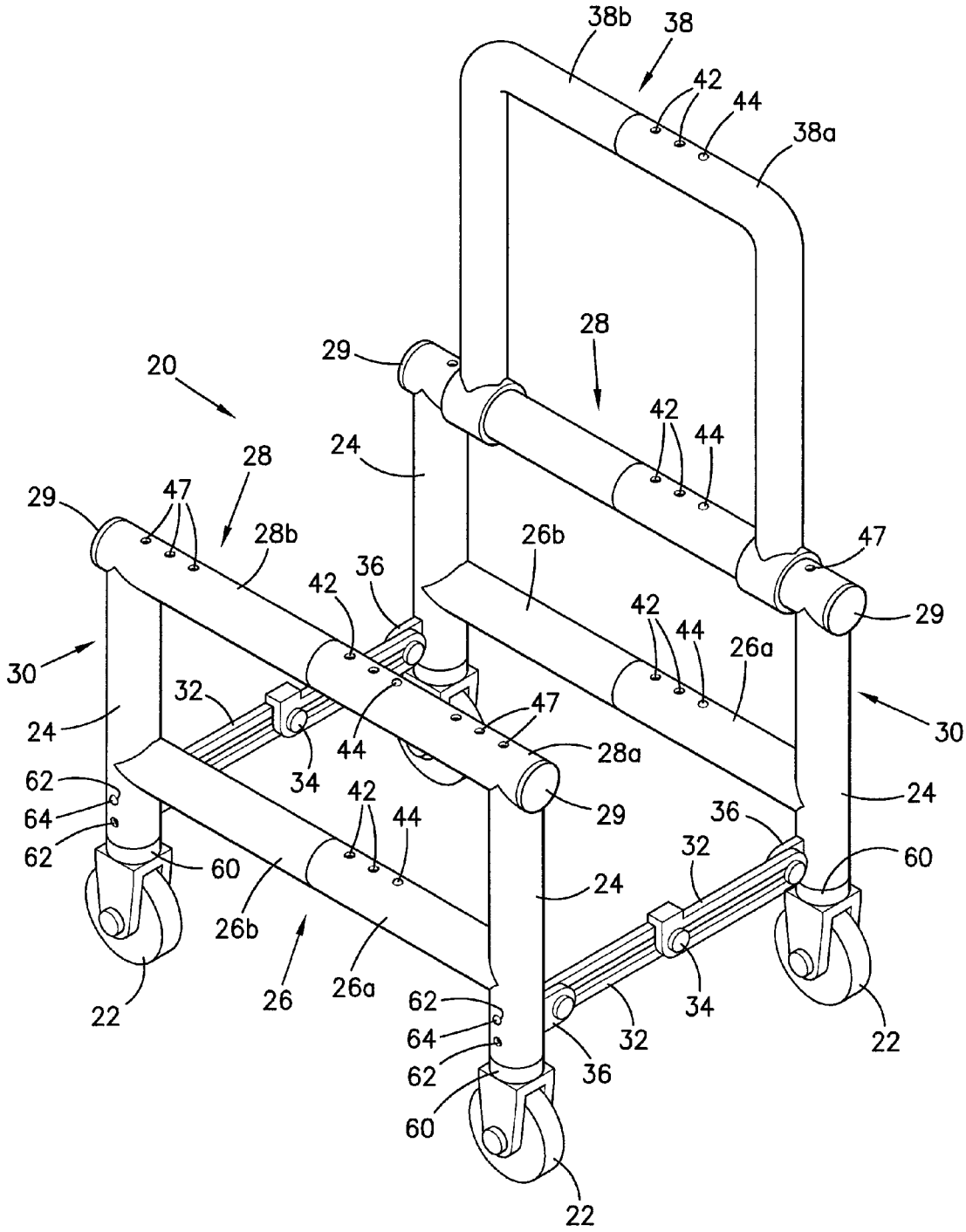
FIG. 1 is a perspective view of the frame of a crawler of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
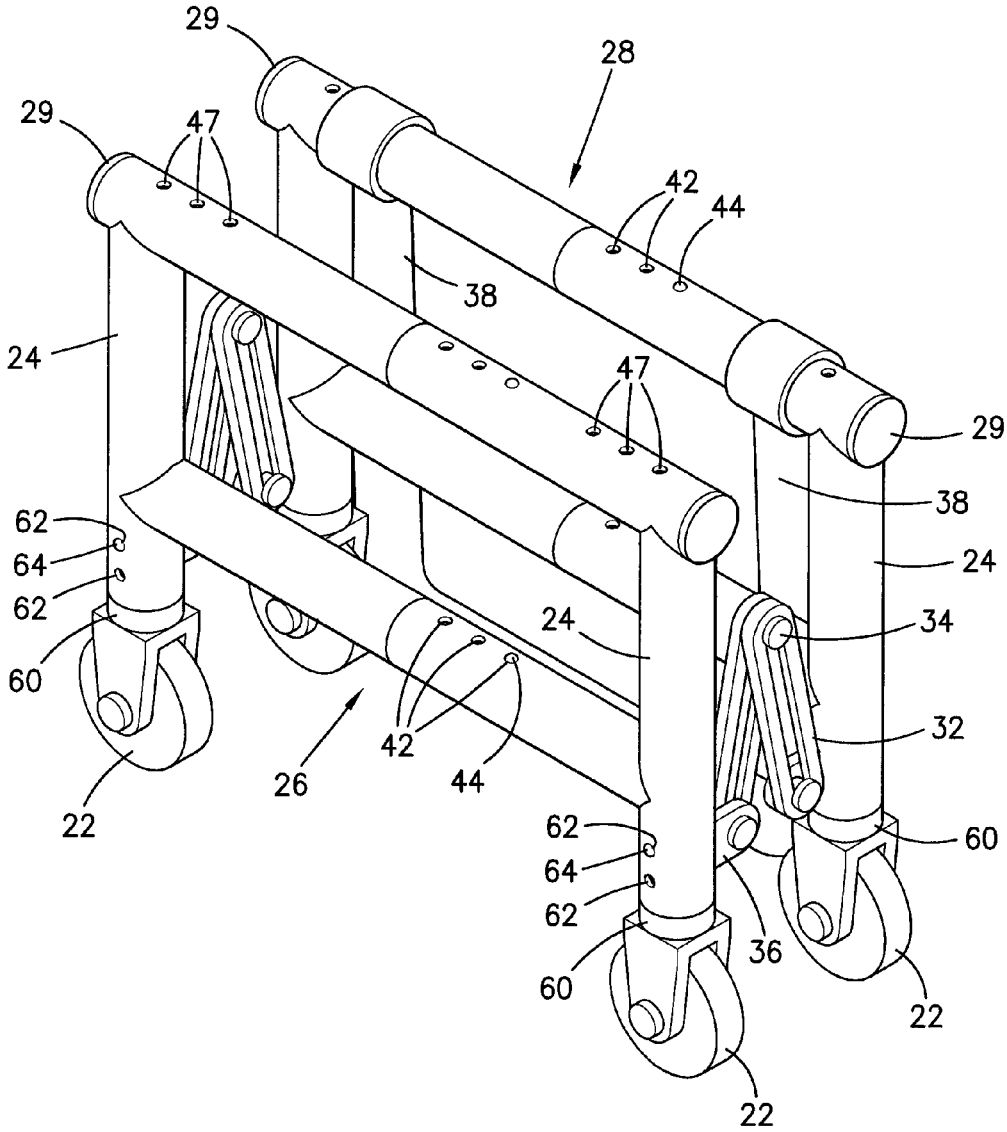
FIG. 2 is a perspective view of the frame of FIG. 1 in a folded condition.
Figure 9:
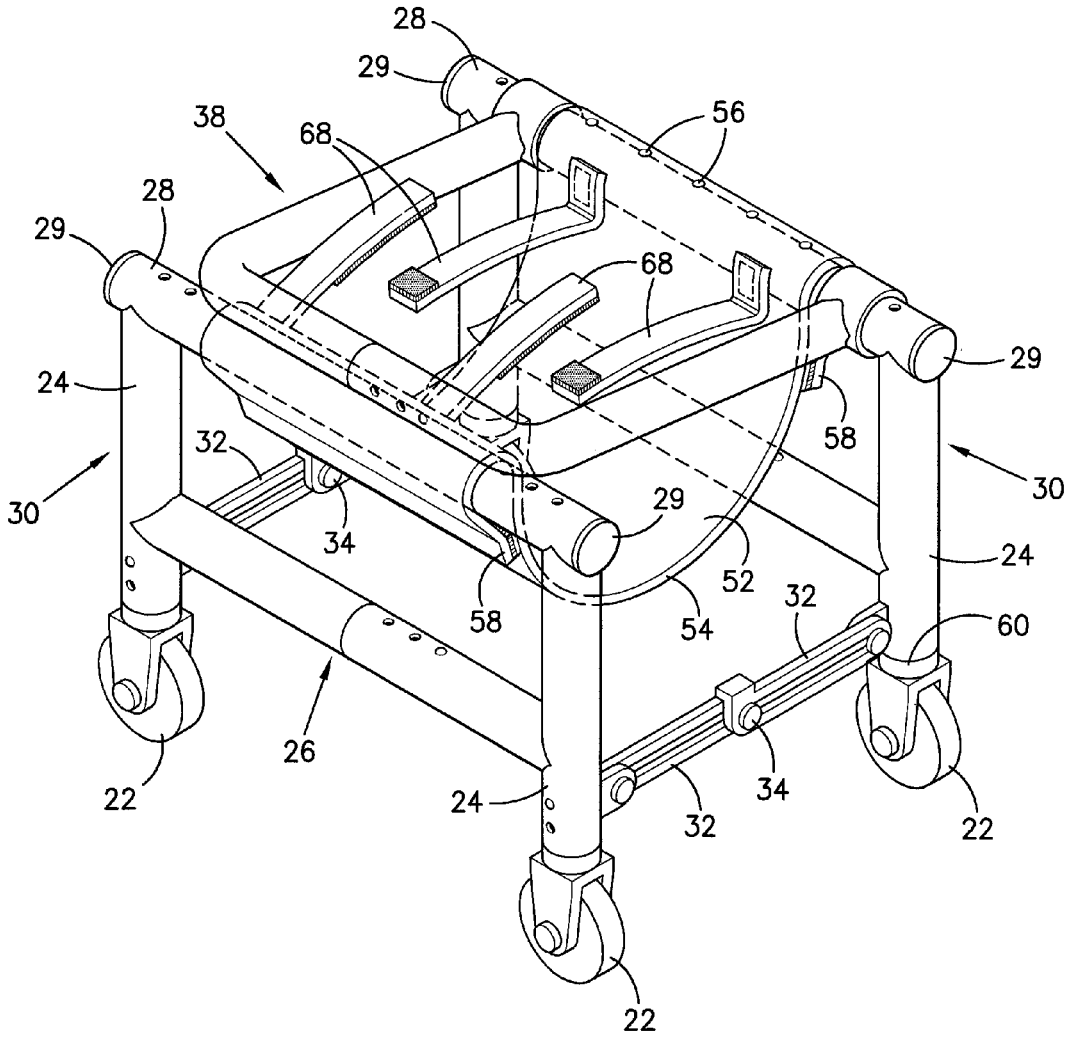
FIG. 9 is a perspective view of the crawler of FIG. 8 showing the top frame member in closed position.

Referring to the drawings, an example of an infant crawler of the invention includes a wheeled frame 20 having wheels 22 which support the frame 20 on a surface such as a floor upon which the frame can be rolled. The wheels may advantageously be rotatably mounted, such as in the manner of caster wheels, to provide for easy turning of the frame. In the embodiment shown, the frame includes four legs 24, pairs of such legs being joined in spaced relationship by intermediate side members 26 and upper side members 28 to form main frame halves 30 connected by frame connecting members 32. While frame connecting members 32 can be rigid and rigidly attached to extend between main frame halves 30 to form a rigid main frame, it is advantageous to provide hinges 34 in connecting members 32 and to pivotally connect connecting members 32 to main frame halves 30, as at connections 36, to provide a foldable or collapsible frame as shown in FIG. 2 whereby the frame can be folded or collapsed by folding connecting members 32 as shown such that the frame can be easily transported and stored. A top frame member 38 is pivotally connected to one of the main frame halves 30 so that it can be rotated between an open position shown in FIG. 1 and a closed position shown in FIG. 9 wherein the top frame member 38 is rotated downwardly as shown in FIG. 9 to extend between main frame halves 30. Further, when the frame is folded into storage condition as shown by FIG. 2, top frame member 38 can be pivoted downwardly to a storage position inside the main frame halves as shown by FIG. 2. Alternately, top frame member 38 could be positioned and sized to pivot downwardly outside the main frame halves.

If desired, the frame can be made adjustable lengthwise. This can be done, for example, by dividing the intermediate side members 26, the upper side members 28, and the top frame member 38 into two telescoping pieces, 26*a* and 26*b*, 28*a* and 28*b*, and 38*a* and 38*b*, respectively, FIGS. 1 and 2. The respective pieces 26*a*, 28*a*, and 38*a* include a plurality of adjusting holes 42 and the respective pieces 26*b*, 28*b*, and 38*b* have a spring loaded ball 44 which is biased outwardly so as to extend into a selected adjusting hole 42 when aligned with the hole to secure the respective telescoping pieces together. By selecting the particular adjusting holes 42 into which the spring loaded balls 44 extend, the lengths of the intermediate side members 26, the upper side members 28, and the top frame member 38 are adjusted to adjust the frame to a desired length. The respective intermediate side members 26, the upper side members 28, and the top frame member 38 can be made telescoping by making pieces 26*b*, 28*b*, and 38*b* of smaller diameter tubing than pieces 26*a*, 28*a*, and 38*a* so that the respective pieces telescope into one another. Spring loaded balls 44 project from each smaller diameter piece 26*b*, 28*b*, and 38*b* so as to mate with different adjusting holes 42 as the pieces are inserted into or withdrawn from the pieces 26*a*, 28*a*, and 38*a*. Alternately, an insert, not separately shown, can be secured in each of the pieces 26*b*, 28*b*, and 38*b* to extend therefrom for insertion into the ends of respective pieces 26*a*, 28*a*, and 38*a* with a spring loaded ball 44 projecting from each extending insert portion so as to mate with different adjusting holes 42 as the extending insert portion is inserted into or withdrawn from the pieces 26*a*, 28*a*, and 38*a*. It should be realized that adjustment of the respective intermediate side members 26, the upper side members 28, and the top frame member 38 will be done simultaneously.

Figure 3:
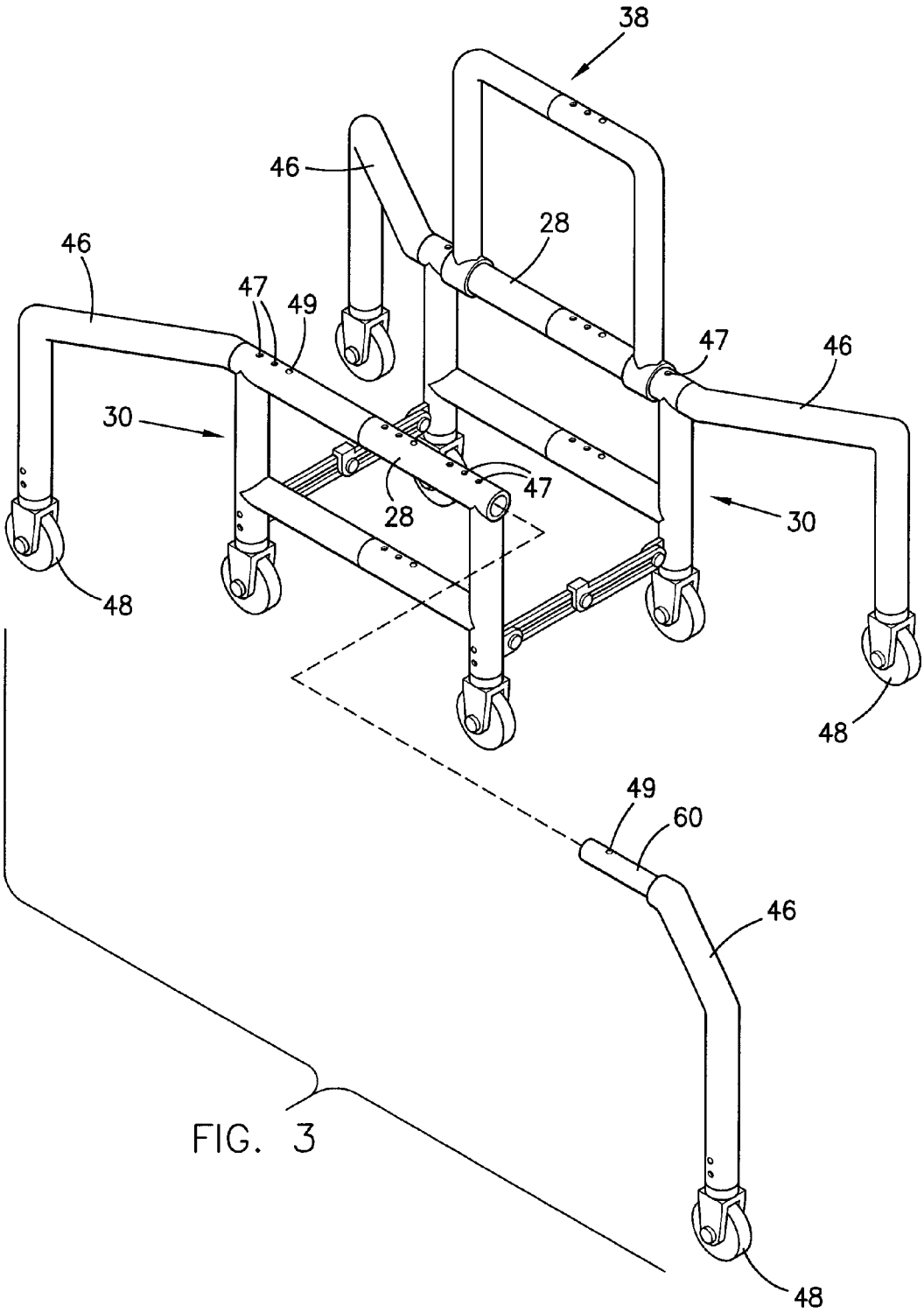
FIG. 3 is a perspective view of the frame of FIG. 1 with auxiliary frame pieces and wheels attached to the ends thereof.

If desired, auxiliary legs 46 with wheels 48, FIG. 3, may be provided either rigidly, pivotally, or removably connected to main frame halves 30 to provide additional support and stabilization to the frame 20. For ease of illustration, FIG. 3 shows these auxiliary legs and wheels removably attached to upper side members 28 of frame halves 30. When removably attached, the upper end portions of legs 46 will form telescoping portions that will fit into the ends of upper side members 28 and upper side members 28 will include a hole 47 for spring loaded ball 49 projecting from the telescoping portions of legs 46 to project into to hold auxiliary leg 46 to upper side members 28. Spring loaded balls 49 are similar to spring loaded balls 44 of pieces 26*b*, 28*b*, and 38*b*. The ends of upper side members 28 may have caps 29 inserted thereinto when auxiliary legs 46 are not used, to provide a finished appearance. While auxiliary legs 46 can extend straight out from the ends of the frames, it is usually advantageous to angle the auxiliary legs outwardly, such as at a thirty degree or a forty five degree angle, to provide additional clearance for the forward (shoulders and arms) and rearward (seat and legs) portions of a user's body positioned in the frame. The auxiliary legs and their particular positions may be desired for stabilization of the frame during use or for support of a cover for the frame as will be described below. However, usually the auxiliary legs and wheels will not be required.

Figure 6:
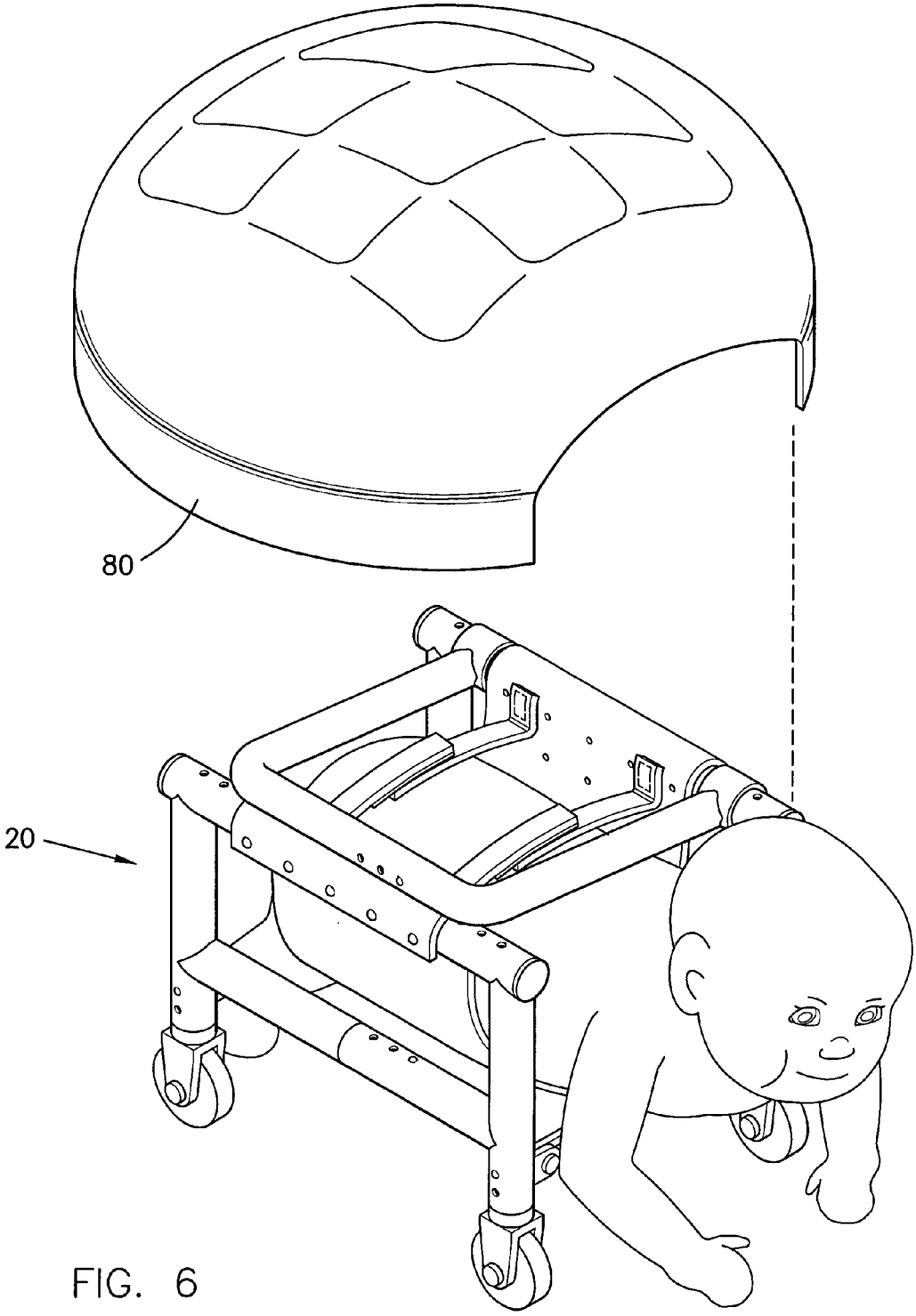
FIG. 6 is an exploded view of a frame similar to that of FIG. 1 and a decorative shell removably attachable to the frame and with an infant positioned in the frame so as to be able to operate the crawler.
Figure 8:
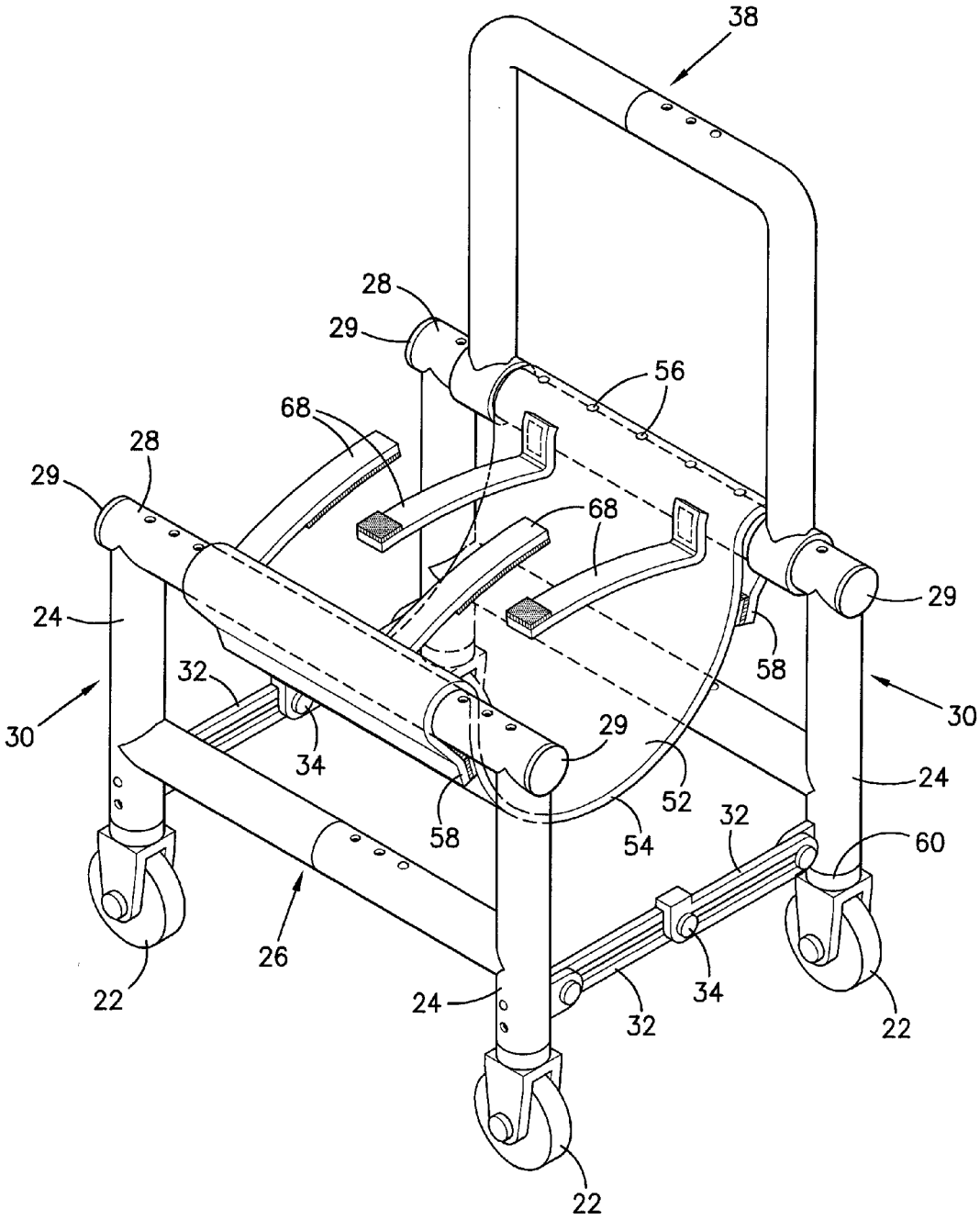
FIG. 8 is a is a perspective view of the crawler of FIG. 1 showing a body supporting surface secured thereto and showing belts provided for holding an infant on the body supporting surface, the top frame member being in open position as in FIG. 1.

A body supporting surface for supporting an infant within the frame so that its hands and feet can contact the ground in order to move the crawler forward or backwards by using its arms and legs can be provided and mounted in the frame in various ways. As illustrated in FIGS. 8 and 9, a body supporting surface 52 can be provided by a length of flexible material 54 secured to extend between the upper side members 28 in the manner of a sling as shown in FIGS. 6, 8, and 9. The attachment of the flexible material 54 to the upper side members 28 may be adjustable so that the height of the body supporting surface 52 in the frame, and therefore above the floor, is adjustable. The longer the length of the flexible material 54 extending between the upper side members, the lower the supporting surface 52 will hang in the frame. The end portions of the flexible material 54 may be provided with a number of rows of holes 56 through which pins or other fasteners, not shown, can be inserted into receiving holes, not shown, in the upper side members 28 and aligned with the flexible material holes 56, to secure the material 54 to the upper side members 28. Rather than pins extending through holes 56 into receiving holes in upper side member 28, upper side member 28 can have tabs projecting from the side members to extend through holes 56 of a selected row of holes 56 to provide the adjustment. Holes 56 can be provided in both end portions of material 54, or can be provided in just one end portion of material 54 to mate with holes or tabs in one of the upper side members 28. Various other mating fasteners positioned along the upper side members 28 and the end portions of the flexible material 54 can be used to secure the flexible material, or pieces of mating hook and loop fastener material can be provided on each end portion 58 of the flexible material 54 so the respective end portions can be looped over the upper side members 28 and fastened back on themselves to connect to the end portions of the flexible material to the upper side members. The height of the body supporting surface 52 with respect to the frame will generally remain above the height of the frame connecting members 32 above the floor.

Rather than adjusting the height of the body supporting surface 52 in the frame by adjusting the length of the flexible material 54, or advantageously in addition thereto, the height of the body supporting surface 52 above the floor can be adjusted by adjusting the length of the legs of the frame. For this purpose, the legs 24 and the auxiliary legs 46 have telescoping leg end pieces 60 which slidingly fit into the respective legs. The respective legs 24 and auxiliary legs 46 each include adjusting holes 62 and the leg end pieces 60 have spring loaded balls or rods 64 which are biased outwardly so as to extend through selected adjusting holes 62 when aligned with the hole to secure leg end pieces 60 when inserted into a leg. By selecting the particular adjusting hole 62 through which the spring loaded ball 64 of the leg end piece extends, the length of the legs is adjusted to a particular desired height. This adjusts the height of the body supporting surface 52 above the floor. If both the sling or flexible material length adjustment and the leg height adjustment are provided, the height of the body supporting surface above the floor can be adjusted over a relatively wide range.

In use of the crawler, the torso of the infant using the crawler is placed on the body supporting surface 52, see FIG. 6. The length of the body supporting surface 52 and the distance between frame connecting members 32 is such that the shoulders and head of the infant user will extend beyond one end of the supporting surface and the adjacent frame connecting member 32 and the seat and legs of the infant user will extend beyond the opposite end of the supporting surface and the adjacent frame connecting member 32. FIG. 6 shows an infant positioned in a crawler of the invention. In some cases, the crawler can be configured so that the infant user will be between the frame connecting members 32. The height of the supporting surface is adjusted to a height so that the hands and knees of the user will reach down to the floor to enable the infant user to crawl with its hands and knees to move the wheeled frame forward or backwards on the floor and to turn the wheeled frame on the floor. Belts 68, FIGS. 8 and 9, can be provided to hold the infant in place on the body supporting surface 52 once positioned on the surface.

The height adjustment features of the body supporting surface allow the height of the body supporting surface to be adjusted to accommodate and provide the correct supporting height for various particular users. Different size infant users will require different height adjustments. Further, if the crawler of the invention is to be used over a period of time with a single infant user, that infant user will grow over the period of time of use and will require adjustment of the height of the body supporting surface as the infant user grows, i.e., as the arms and legs of the infant user get longer. Further, the length adjustment feature of the frame allows adjustment of the length of the frame and of the distance between the frame connecting members to allow different lengths of the body supporting surface to be provided, if desired, as the infant user grows or for different size users. Having a correct length for the user will increase the stability of the frame during use, particularly if the auxiliary legs and wheels are not used.

Figure 4:
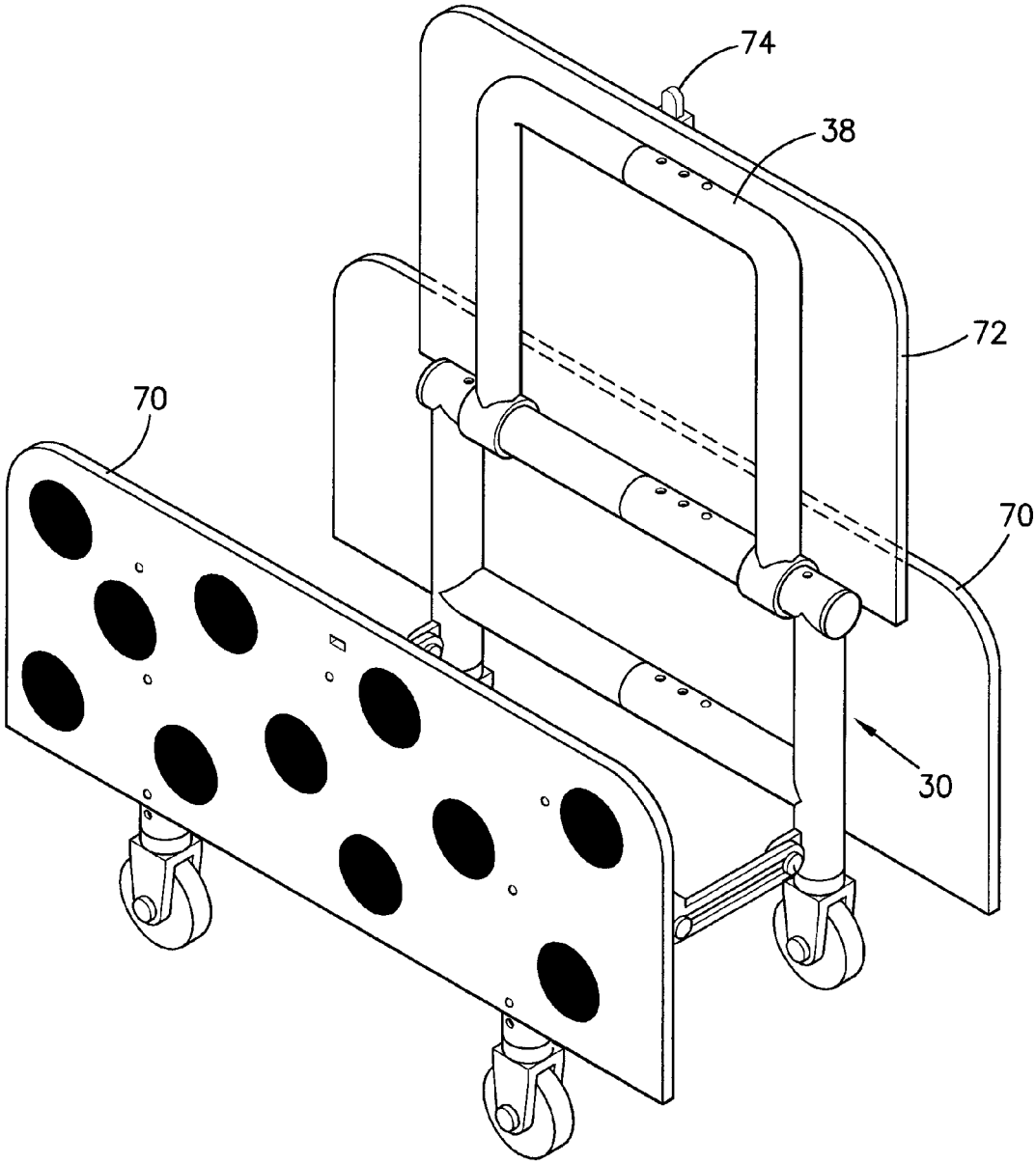
FIG. 4 is a perspective view of the frame of FIG. 1 with side panels and a top panel attached thereto so as to turn the frame into a representation of an object other than a crawler, with the top panel in open position to allow access to the inside of the crawler.
Figure 5:
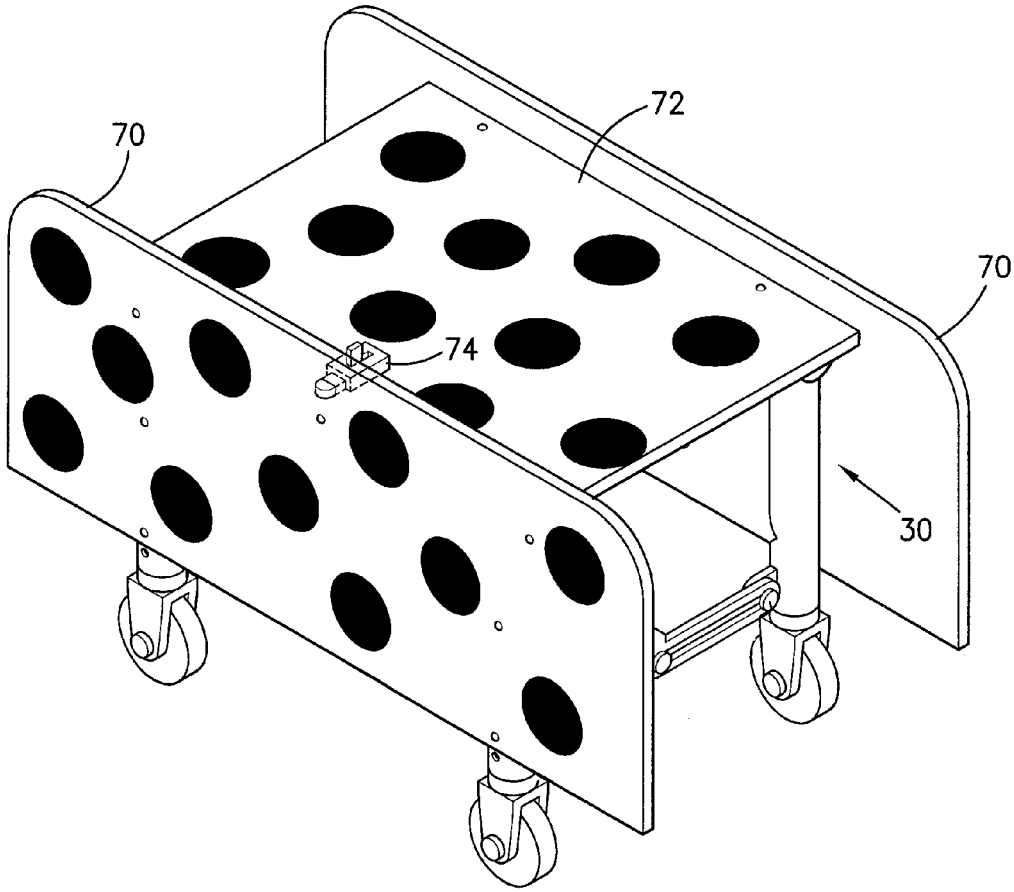
FIG. 5 is a perspective view of the crawler of FIG. 4 with the top panel in closed position.
Figure 7:
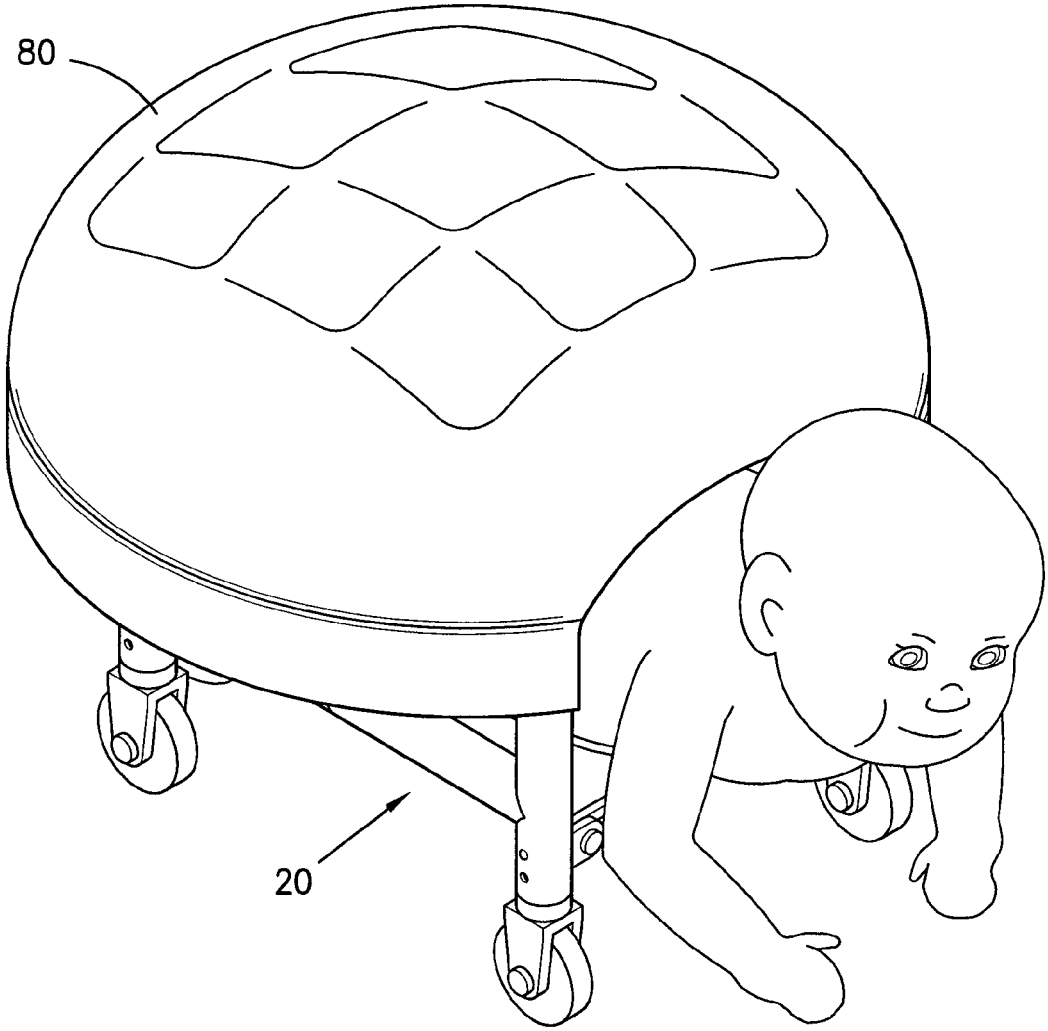
FIG. 7 is a perspective view of the frame of FIG. 6 with the shell of FIG. 6 attached thereto and with an infant positioned in the frame so as to be able to operate the crawler.

A feature of the crawler of the invention is that a cover can be provided for the frame so that the crawler can take various decorative forms. For example, the cover can be configured to provide the shape of an animal to the crawler, such as, for example, a lady bug, turtle, spider, or butterfly. Other shapes such as an automobile, train, airplane, rocket ship, etc. can be provided. FIGS. 4 and 5 show how animal sides 70 can be mounted to the outer sides of the frame halves 30 and an animal top 72 can be mounted to the frame top member 38 or can form the frame top member. FIG. 4 shows the top 72 and top frame member 38 open so that the infant can be placed in the crawler while FIG. 5 shows the top 72 and top frame 38 closed. A push button lock or other lock 74 can be provided to latch the top 72 in closed position. FIG. 5 shows the crawler with the animal sides 70 and animal top 72 decorated to provide the crawler with a ladybug appearance. FIGS. 6 and 7 show the sides and top with a rounded appearance and shows a representation of a turtle with the infant's head extending from one end of the turtle body to provide the head of the turtle and with the infant's rear end and legs extending from the opposite end. This rounded cover could be provided by the sides and top as shown in FIGS. 4 and 5, or, as shown in FIGS. 6 and 7, can be a single piece cover or shell 80 that is placed over the frame after the infant is placed in the frame. With the single piece cover 80, the cover and frame are provided with mating contact points or surfaces to position the cover in a predetermined manner on the frame. The single piece cover 80 can be formed of a shape retaining material, such as, for example, a substantially rigid plastic material or of a cardboard material, can be formed of a fabric material with a supporting frame, such as, for example, a folding frame similar to an umbrella frame, or may merely be a fabric or plastic material which is positioned over or draped over the frame to provide the decorative shape to the crawler.

With the various shapes provided for the crawler, the infant can pretend to be an animal moving across the floor or can pretend to be in a vehicle such as a car moving around the floor. This adds to the play value of the crawler and makes it more fun for the user of the crawler and for observers.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A crawler, comprising:

a frame;

a body supporting surface mounted in the frame;

wheels mounted on the frame to allow the frame to roll on a surface; and a cover mounted on the frame to provide a representation of an animal over the frame which will cover at least a portion of the user when the crawler is in use and wherein the animal representation has an opening through which the head of a user can extend to form a head for the animal.

2. The crawler of claim 1, wherein the cover includes sides and a top to provide the animal shape.

3. The crawler of claim 1, wherein the cover is separable from the frame and is placed over the frame.

4. The crawler of claim 1, wherein the frame is collapsible.

5. The crawler of claim 1, wherein the height of the body supporting surface is adjustable.

6. The crawler of claim 1, wherein the length of the frame is adjustable.

* * * * *